US006142653A

United States Patent [19]

Larson

[11] Patent Number: 6,142,653

[45] Date of Patent: Nov. 7, 2000

[54] OPTICAL PATTERN PRODUCING SYSTEM

[75] Inventor: Thomas Blaise Larson, Champlin, Minn.

[73] Assignee: Physicreations, Inc., Champlin, Minn.

[21] Appl. No.: 09/093,379

[22] Filed: Jun. 8, 1998

[51] Int. Cl.[7] ..... F21V 7/00

[52] U.S. Cl. ..... 362/284; 362/322; 362/285; 353/48; 353/46; 353/50

[58] Field of Search ..... 362/283, 322, 362/284, 324, 281, 298, 811, 259; 355/285; 353/1, 46, 48, 49, 50, 51; 359/616; 235/467; 99/51

[56] References Cited

U.S. PATENT DOCUMENTS

| | | | |
|---|---|---|---|
| Re. 21,387 | 3/1940 | Curtis | 353/51 |
| 3,892,478 | 7/1975 | Lampkin . | |
| 4,171,902 | 10/1979 | Imai et al. | 355/11 |
| 4,247,181 | 1/1981 | Inness-Brown . | |
| 4,327,975 | 5/1982 | Harris . | |
| 4,814,800 | 3/1989 | Lavinsky et al. . | |
| 4,827,387 | 5/1989 | Ferren et al. | 362/284 |
| 5,050,056 | 9/1991 | Ellison . | |

*Primary Examiner*—Sandra O'Shea
*Assistant Examiner*—Bertrand Zeade
*Attorney, Agent, or Firm*—Merchant & Gould P.C.

[57] ABSTRACT

There is disclosed a system that produces patterns or images from a light beam by a series of reflections off of multiple mirrors, these mirrors rotated by motors. The mirrors are positioned with respect to each other and offset at a predetermined angle from a plane perpendicular with respect to the transverse vertical plane extending axially through the respective motors. This positioning creates a path of travel for the light beam that crosses over on itself at least once, allowing for the maximum number of patterns to be produced from a maximum number of mirrors, that are all preferably substantially uniform in their diameter (largest transverse dimension).

29 Claims, 6 Drawing Sheets

OPTICAL PATTERN PRODUCING SYSTEM

FIELD OF THE INVENTION

The present invention relates to optical display systems, and in particular to display systems that produce and project visible images onto a visually detectable medium, such as a wall, ceiling, screen, floor, sidewalk, fog, smoke or the like.

BACKGROUND OF THE INVENTION

"Laser" light shows are popular forms of entertainment. Typical laser light shows involve a device that generates many different light patterns and projects these patterns on to surfaces such as walls, ceilings, screens, floors, sidewalks, fog, smoke, etc. However, the devices employed for generating and projecting these laser light patterns are large, complex and expensive, whereby these laser light displays are only viewable at large events, concerts or the like.

One device known for generating light patterns is a LASER ONE™ FX machine available from Hoffman Products International, Inc., Dallas, Tex. This machine generates various patterns by shining a beam of laser light onto a first large rotating mirror, that in turn reflects this beam onto a second larger diameter rotating mirror, prior to the beam leaving the device as a pattern. The mirrors are positioned, such that the reflected beam travels in a serial manner, but does cross over itself at any point along the beam pathway. The motors associated with rotating the mirrors are only capable of rotating the mirrors at a maximum of 3000 RPM.

As a result of this arrangement, the LASER ONE™ FX machine exhibits several drawbacks. With only two mirrors of increasing diameter in alignment to produce a serial path of laser beam travel, that does not cross over itself, the number of possible patterns generated is limited. Moreover, this mirror arrangement, and subsequent serial path of laser beam travel causes the projected beam to contact or impact the mirror surfaces at angles substantially less than perpendicular thereto (approximately 45 degrees), these angles commonly referred to as extreme angles. Contact or impact on the mirrors at these extreme angles is commonly known as extreme angle impact, and results in elliptical aberrations in the patterns produced by this device. The speed of the motors (maximum 3000 RPM) also limits the number of potential patterns.

Should a device be desired that produces additional patterns in accordance with the LASER ONE™ mirror arrangement, i.e., serial, any successive mirror or mirrors would have to be larger in diameter, to reflect all of the continued divergent beam directed thereon. Therefore, the size of the device would have to be increased to accommodate these additional larger diameter mirrors.

SUMMARY OF THE INVENTION

The present invention overcomes the problems of the prior art by providing a system that allows for the creation of the maximum number of light beam patterns or images, for the number of small substantially uniform diameter rotatable mirrors, the mirrors positioned in a unique arrangement. The patterns produced are highly aesthetic, as they are substantially free of elliptical aberrations.

The present invention is a system that produces patterns or images from a light beam by a series of reflections off of multiple rotatable mirrors. The system includes a source for producing a light beam, and multiple rotatable mirrors, each mirror rotated by a motor. Each mirror is offset at a predetermined angle from a plane perpendicular with respect to the transverse vertical plane extending axially through the respective motors. The mirrors are positioned in an arrangement that allows for the projected beam, from the light beam source, to be reflected such that the path of beam travel crosses over on itself at least once. This positioning maximizes the number of patterns that can be produced as well as maximizes the number of mirrors, that are all preferably substantially uniform in their diameter (largest transverse dimension), that can be used.

BRIEF DESCRIPTION OF THE DRAWINGS

The present invention will be described with reference to the accompanying drawings, wherein like reference numerals identify corresponding or like components.

In the drawings.

DETAILED DESCRIPTION OF THE DRAWINGS

Figure 1:
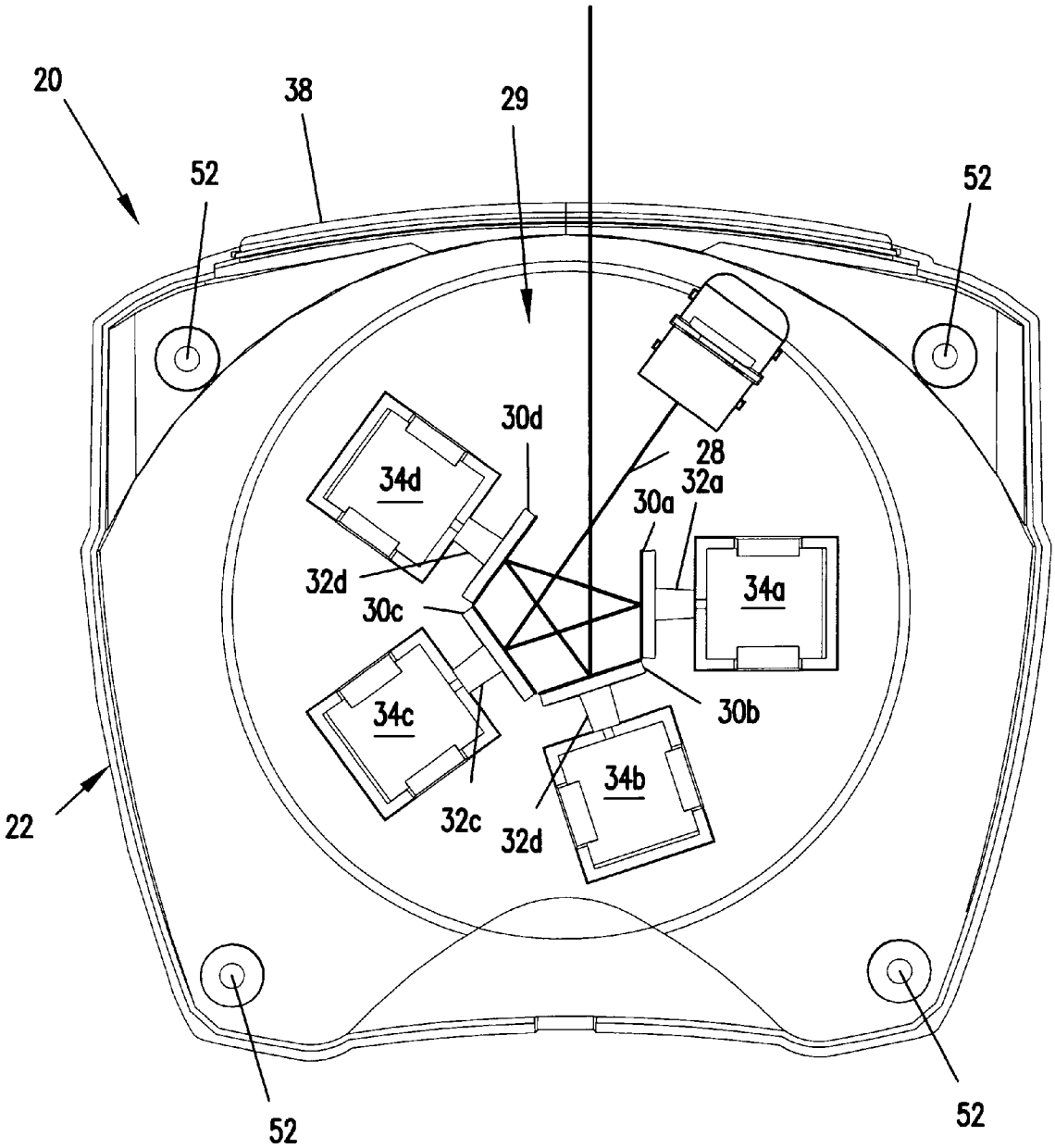
FIG. 1 is a top view of the present invention in operation, with the upper portions of the apparatus cut away.

Turning to FIG. 1, the apparatus 20 of the present invention includes a housing 22 with an internal cavity 24. A light beam generator, such as a laser beam generator 26, for generating a laser beam 28, is affixed to the housing 22. Rotatable mirrors 30*a*–30*d* are preferably mounted on shafts 32*a*–32*d*, that in turn are attached to motors 34*a*–34*d*. These motors 34*a*–34*d* are designed to rotate the shafts 32*a*–32*d* and thus, rotate the respective mirrors 30*a*–30*d*.

The motors 34*a*–34*d* are mounted in position in the apparatus 20 by motor mounts 36*a*–36*d*. The laser beam generator 26 and mirrors 30*a*–30*d* are arranged (as per their respective mounts) pentagonally. This arrangement results in the laser beam 28 traveling in a cross-over path, as it crosses over itself at several points. For example, the path shown is in the shape of a five pointed star, prior to the laser beam's 28 exit, through a window 38 at the front of the apparatus 20. The laser beam 28 exits the apparatus 20 and appears on a visually detectable medium, such as a wall, ceiling, screen, fog, smoke or the like, as a continuously changing visible pattern (or image).

Figure 2:
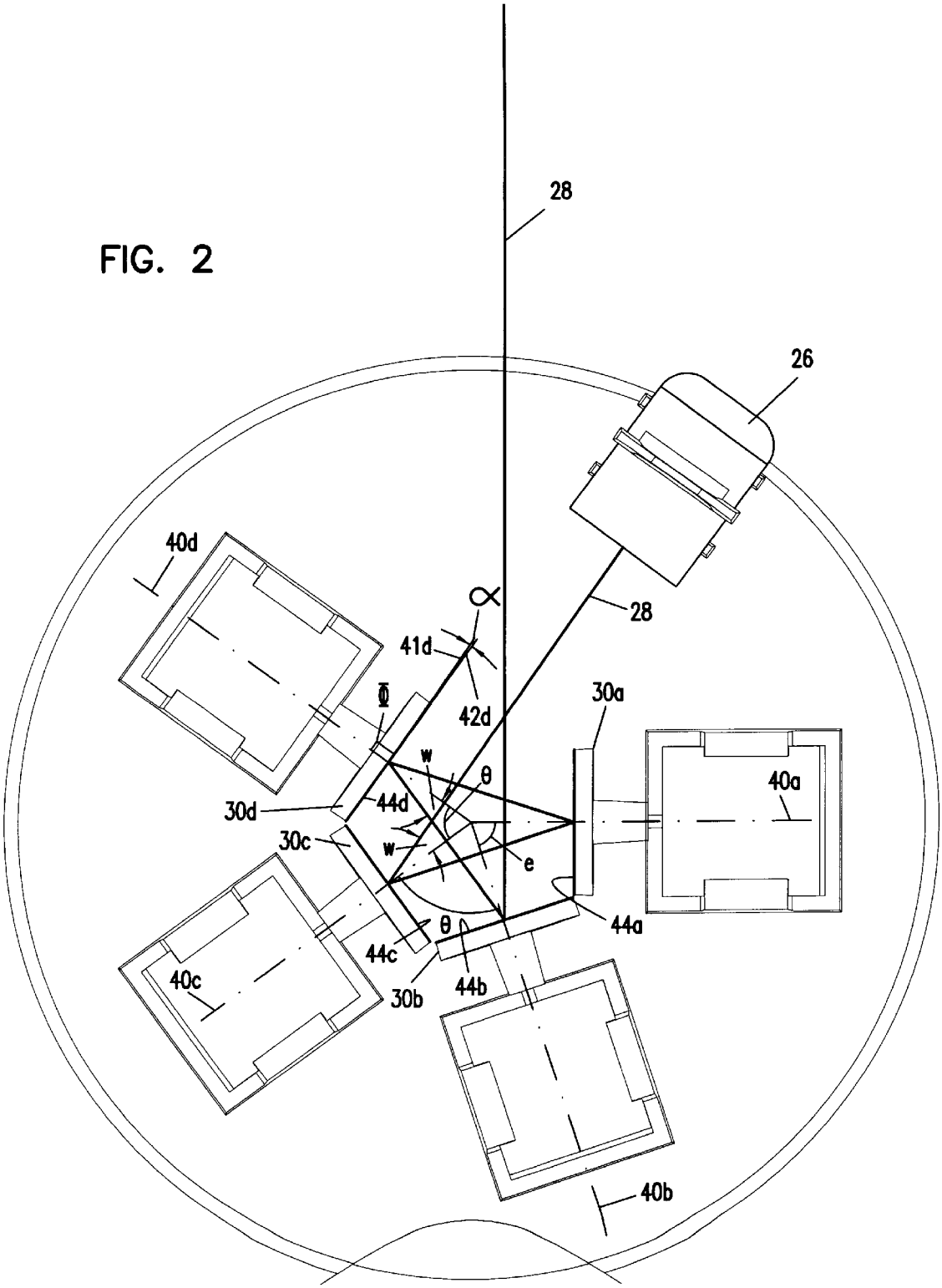
FIG. 2 is a top view of the mirrors of the present invention.

Turning also to FIG. 2, there is detailed the mounting and positioning of each mirror 30*a*–30*d*. The mirrors 30*a*–30*d* shown are in a polygonal, preferably pentagonal, arrangement or configuration. The shafts 32*a*, 32*b* and motors 34*a*, 34*b* have longitudinal planes 40*a*–40*d* extending therethrough, these longitudinal planes oriented an angle $\Theta$ with respect to each other. With the mirrors 30*a*–30*d* and the laser beam generator 26 in the pentagonal configuration, the angle $\Theta$ is approximately 72°, in accordance with a formula: 360° divided by the number of sides, this number of sides is determined by the number of mirrors, each mirror defining a side plus the allocation of a side for the laser beam generator 26 or the like. Transverse perpendicular planes 41*d* (other corresponding planes not shown), bisect these longitudinal planes 40*a*–40*d*, at right angles $\Phi$, respectively. In alternate embodiments, additional or fewer mirrors may be used and oriented in accordance the respective polygonal configuration, positioned in accordance with the formula detailed above.

The mirrors 30*a*–30*d* are slightly offset or angled, so as to "wobble", when rotated in the clockwise and counterclockwise directions. This "wobble" allows for the production of additional patterns upon beam 28 exit from the apparatus 20. Specifically, planes 42*d* (other corresponding planes not shown) parallel to the surfaces 44*a*–44*d* of each respective mirror 30*a*–30*d,* intersect the respective transverse perpendicular planes 41*d* (other corresponding planes not shown) an angle α, of between greater than 0 and less than 90 degrees, and preferably approximately 0.5 degrees.

It is also preferred to have the laser beam 28 contact each mirror 30*a*–30*d* at a "tight" angle to the perpendicular of the plane defined by the mirror surface. This "tight" angle is preferably as close as possible to the perpendicular to the plane of the mirror surface, for example surface 42*d* (other corresponding surfaces for the other mirrors 30*a*–30*c* not shown). Here, beam contact with the mirrors 30*a*–30*d* is being made at angles ω (illustrated for mirrors 30*c* and 30*d*), that are approximately 18±0.5° (with slight deviations of an another approximately ±0.5° occurring upon contact with each successive mirror, as a result of the "wobble" of the successive mirrors, in accordance with the cross-over pattern for laser beam 28 travel). Since the beam 28 contacts the mirror at this "tight" angle ω, extreme angle impact is avoided and, thus, the number of elliptical aberrations, that cause unasthetic patterns, is minimized.

Figure 3:
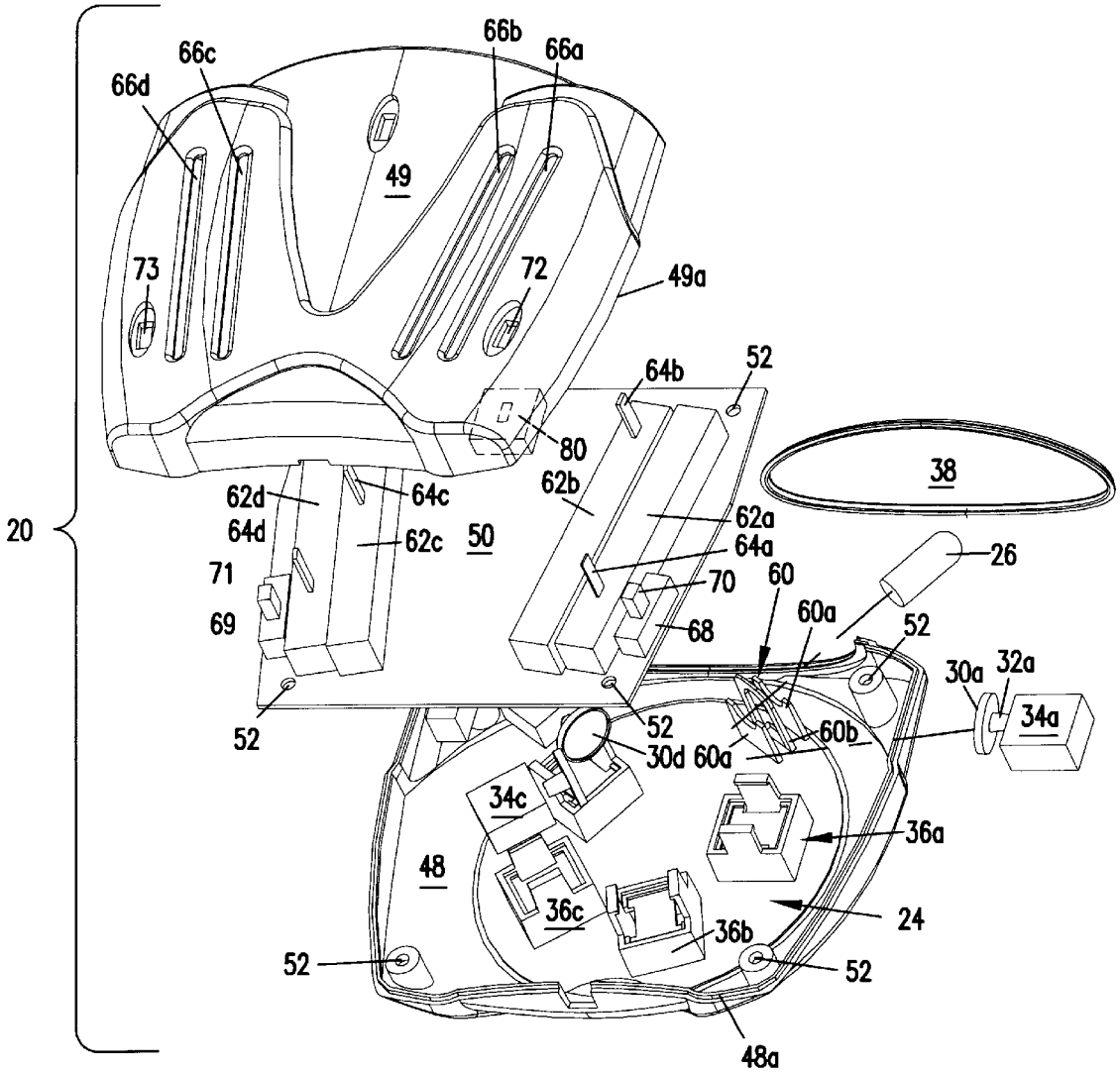
FIG. 3 is an exploded view of the present invention.
Figure 4:
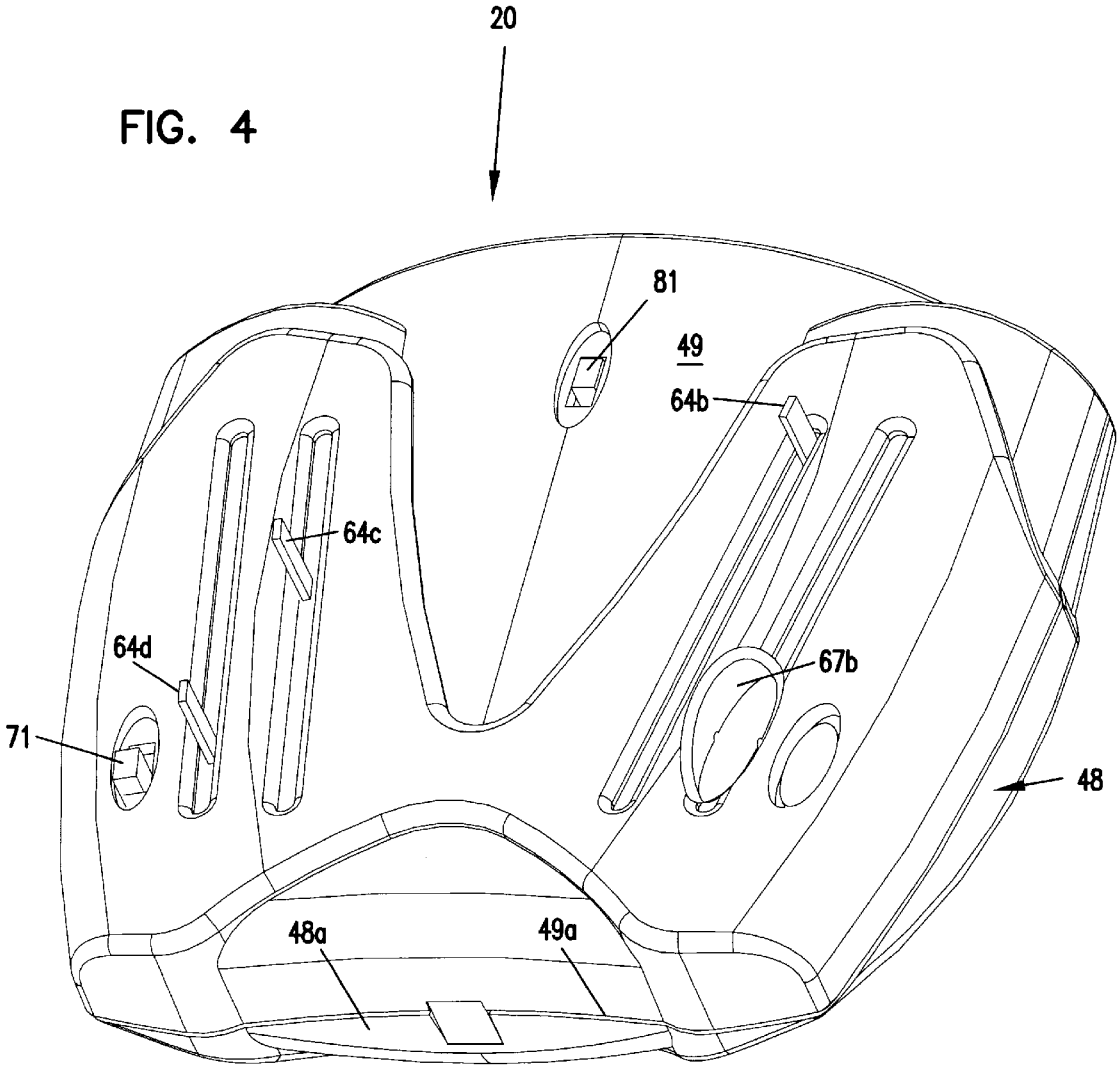
FIG. 4 is a perspective view of the present invention.
Figure 7:
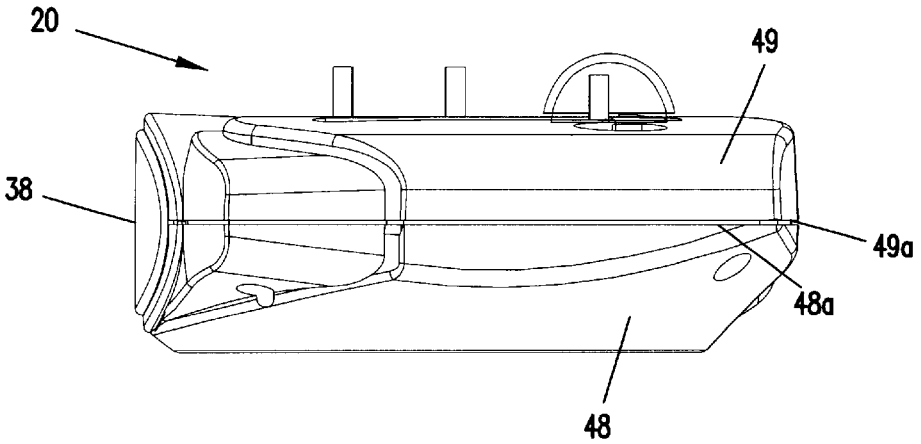
FIG. 7 is a side view of the present invention.

Turning also to FIG. 3, there is shown the entire apparatus 20, including the housing 22, as divided into shells 48, 49 and a support member, such as a printed circuit board 50 or the like, for supporting the control electronics associated with the apparatus 20. The shells 48, 49 are preferably made of a hard plastic, such as ABS plastics, or the like, by techniques such as injection molding, or the like. These shells 48, 49 combine with the window 38, that forms a portion of the front face of the apparatus 20, to encase the electronics and laser beam pattern producing structures, contained within the cavity 24. The window 38 is preferably of a transparent or tinted plastic material, such as polycarbonates or styrenes, tinted red, or other suitable tint color, to allow the laser or light beam to pass through and create the requisite patterns.

Turning also to FIGS. 4–7, the shells 48, 49 include edges 48*a*, 49*a* that cooperatingly configured (and similarly cooperatingly configured with respect to the window 38 at the front end of the apparatus 20), such that when these shells 48, 49, window 38 and support member are joined together, by screws 51 (partially shown in FIG. 5, otherwise not shown), through the respective screw openings 52 (FIGS. 1, 3 and 5) extending from the lower shell 48 through the circuit board to the upper shell 49, there is a tight secure fit of all parts, that is aesthetically pleasing both externally and internally.

The lower shell 48 includes a holding unit 60 for the laser beam generator 26, preferably of three members 60*a*, 60*b* cooperatingly arranged to frictionally engage the laser beam generator 26, retaining it in a fixed position. Additional securement of the laser beam generator 26 may be achieved with adhesives or additional mechanical fasteners. The laser beam generator 26 preferably generates a visible laser light beam 28 (laser beam), in colors including red, green or others, and may be of modulated or continuous duration.

Figure 5:
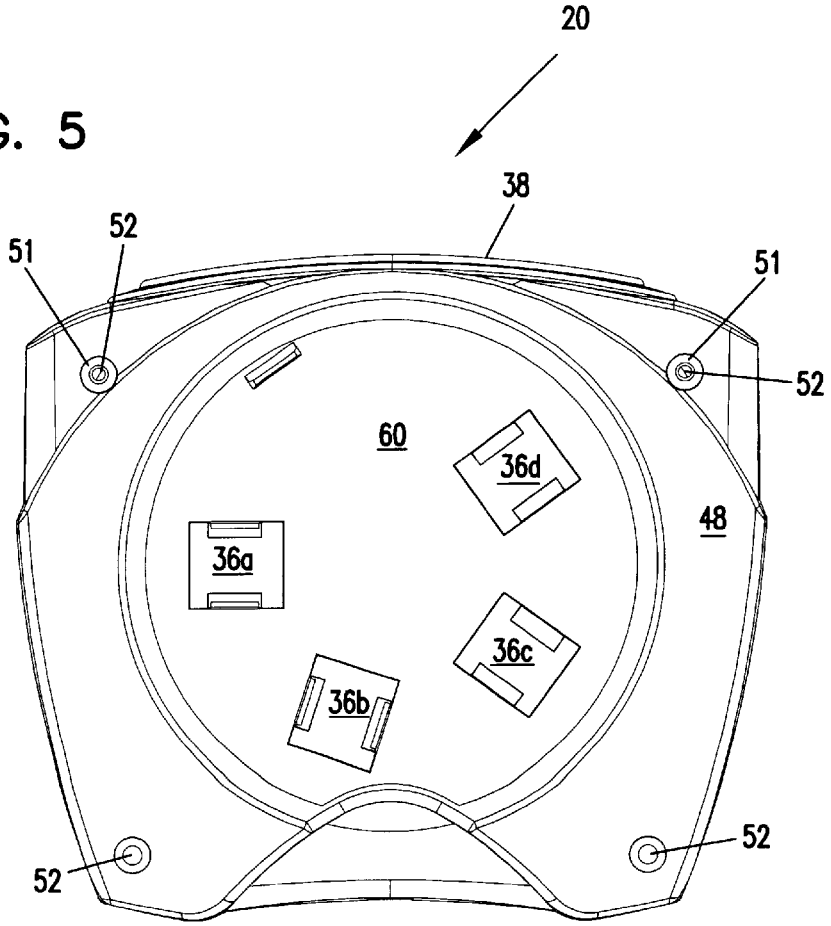
FIG. 5 is a bottom view of the present invention.
Figure 6:
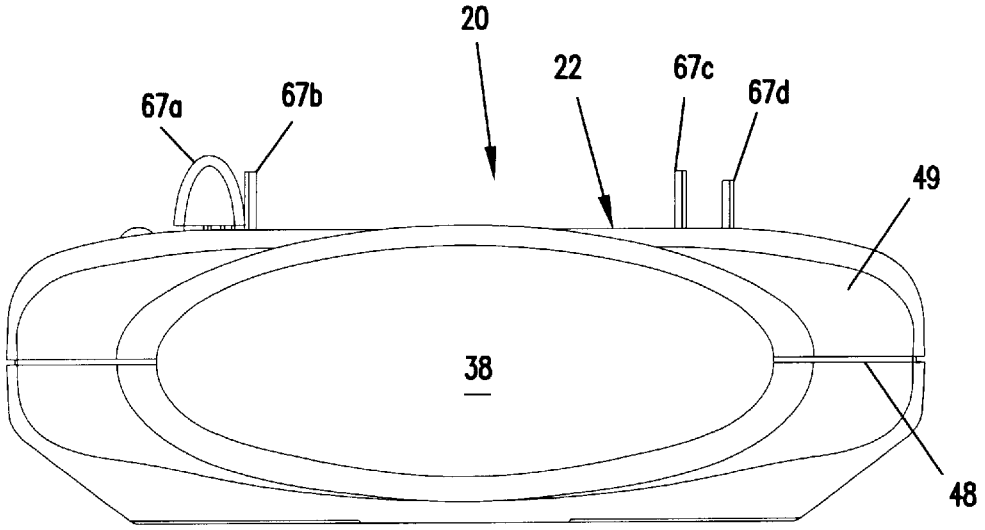
FIG. 6 is a front view of the present invention.

Motor mounts 36*a*–36*d* are at positions corresponding to the mirrors 30*a*–30*d,* and are thus approximately 72° apart from each other (FIGS. 3 and 5). These motor mounts accommodate motors 34*a*–34*d* by a snap-engagement, or other mechanical type engagements, although adhesion for additional securement is also permissible. Accordingly, this mounting also sets the position of the mirrors 30*a*–30*d* and respective shafts 32*a*–32*d,* as well.

The motors 34*a*–34*d* are preferably variable speed motors, to approximately 30,000 RPM, with approximately 26,000 RPM maximum speed motors preferred. These motors preferably rotate the mirrors bidirectionally (in both the clockwise and counterclockwise directions). For example, motors such as servo motors, DC motors or stepping motors may be used. Also, fixed speed motors that rotate a shaft in only a single direction (clockwise or counterclockwise) are also permissible. In a preferred arrangement of motors that combines bidirectional and unidirectional motors, motors 34*a* and 34*c* are bidirectional while motors 34*b* and 34*d* are unidirectional. Other combinations, such that at least one motor is bidirectional and at least one motor is unidirectional are also permissible. Bidirectional motors, that change direction at predetermined intervals, that may be speed controllable (manually or automatically) or fixed speed, are permissible as are unidirectional motors that can be speed controllable (manually or automatically). Still other combinations with all motors bidirectional or all motors unidirectional are also permissible. In all combinations employing one or more unidirectional motor(s), each unidirectional motor may rotate in either the clockwise or counterclockwise directions.

The printed circuit board 50 supports and provides electrical connections (not shown) to motor controllers 62*a*, 62*b*, 62*c*, 62*d* electrically connected by conventional electronics to the respective motors 34*a*–34*d* (additional connections not shown) that control the speed of the motors 34*a*–34*d* by their manual movement of members 64*a*–64*d*. The members 64*a*–64*d* extend through corresponding openings 66*a*–66*d* in the upper shell 49, and attach to covers 67*a*–67*d* (FIG. 6) outside of the upper shell 49. Reverse motor controllers 68, 69 are preferably electrically connected to motor controllers 62*a* and 62*c*, respectively. These reverse motor controllers 68, 69, are controlled by switches 70, 71, that extend through openings 72, 73 on the outer shell 49 to be activated and deactivated my manual manipulation.

The printed circuit board 50 is also configured for supporting a power source 80 (shown in broken lines) and/or associated electronics (not shown), such as a battery (not shown) or an AC adapter or the like. The power source is electrically connected to the laser generator 26 as well as all of the motor controllers 62*a*–62*d* and reverse motor controllers 68, 69 by conventional electronics. This power source 80 includes a switch 81 (FIG. 4), that extends through an opening 82 on the outer shell 49 to be activated and deactivated my manual manipulation.

Additionally, the apparatus 20 may include an LED emission indicator and beam attenuator that would be electrically connected to the power source 80 and the laser beam generator 26 by conventional electrical connections. This device would be cut into the outer shell 49, such that it would be visible to the user(s).

While the mirrors 30*a*–30*d* are rotatable, as many as three could be stationary, with the single or multiple rotatable mirror(s) being rotatable either unidirectionally or bidirectionally, or a combination of both rotations (intervals in each direction). The mirrors 30*a*–30*d,* when rotated by their respective motors 34*a*–34*d*, are preferably rotated at speeds of at least approximately 960 RPM. This at least 960 RPM speed will avoid flickering of the resultant patterns, and produce a solid, non-flickering pattern. Also, should more than two mirrors be rotating, rotations may be in ratios with these ratios having least common multiples of 26,000, corresponding to the maximum speed of 26,000 RPM.

Example operations of the apparatus 20, described and shown above, are now detailed. These example operations involve adjustment of the parameters detailed above, these parameters including rotational direction(s) and rotational speed(s) for each mirror, the "wobble" for each mirror, preferably at approximately 0.5°, the number of mirrors, and positioning of these mirrors with respect to their adjacent mirror as well as the mirror arrangement as a whole (polygonal). As a result of the large number of variable parameters, a large number of potential patterns (or images) can result, with the most pleasing pattern being subjective with each individual user. Moreover, even a single change in any parameter will result in a unique pattern. Accordingly, two example operations are detailed.

In operation, the power source 80 is activated, such that the laser beam generator 26 emits a laser beam 28. The emitted laser beam 28 directs off of a first mirror 30*c*, that is preferably rotating in a reverse (counterclockwise) direction by a bidirectional motor, at approximately a 0.5° "wobble". The reflected beam 28 then contacts a second mirror 30*a*, also rotating in a reverse (counterclockwise) direction, by a bidirectional motor, at approximately a 0.5° "wobble". The reflected beam then reflects off of a third mirror 30*d*, rotating in a forward (clockwise) direction, by a unidirectional motor, at approximately a 0.5° "wobble", with the reflected beam 28 reflecting off of a fourth mirror 30*b*, also rotating in a forward (clockwise) direction, by a unidirectional motor, at approximately a 0.5° "wobble". From this fourth mirror 30*b*, the beam 28 exits the apparatus, where it is projected as a continuously changing pattern on the wall, ceiling or other external surface. At a desired time, the rotational directions of mirrors 30*a*, 30*c* are reversed to clockwise (by controlling the respective motors 34*a*, 34*c*), and this process is repeated. Throughout this operation, the speed of the rotations for each of the mirrors 30*a*–30*d*, can be controlled (increased and/or decreased) by controlling the corresponding motor 34*a*–34*d*, thus, increasing the number of continuously generated patterns.

The four motors 34*a*–34*d*, that rotate the respective mirrors 30*a*–30*d*, can operate, by being user set, or predetermined (automatic), for operation at various ratios, to produce the resultant patterns. Generally, the ratios of motor speeds (RPM) for the four motors are expressed as: w:x:y:z, where w is the speed of motor 34*c*, x is the speed of motor 34*a*, y is the speed of the motor 34*d*, and z is the speed of the motor 34*b*. A permissible ratio is one where of all four variables (w, x, y, z) have a least common multiple (variable "z") of not greater than 26,000, such that any one motor does not exceed the 26,000 RPM preferred limit. The ratio variable "w" is preferably at a minimum of approximately 960 RPM. Exemplary ratios are 1:2:3:4 and 1:4:7:9, corresponding to w:x:y:z, respectively.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An image producing system comprising:

a light beam source for producing a light beam;

a plurality of rotatable members, each of said rotatable members including a longitudinal vertical plane and a transverse vertical plane extending therethrough, said longitudinal vertical plane and said transverse vertical plane oriented substantially perpendicular to each other;

means for driving each of said plurality of rotatable members;

a plurality of substantially planar mirrors, each of said mirrors in communication with a rotatable member from said plurality of rotatable members, each of said mirrors including a surface defining a vertical mirror plane offset at a predetermined angle with respect to said transverse vertical plane;

said light beam source and said plurality of mirrors aligned so as to produce a path of travel for said light beam that begins at said light beam source, reflects sequentially from each of said plurality of mirrors, and exits said system, whereby rotation of at least one of said plurality of mirrors produces a periodic angular motion of said path of travel of said light beam;

whereby said periodic angular motion of said path of travel for said light beam produces an image in up to two dimensions when said light beam is projected on a visually detectable medium; and said light beam source and said plurality of mirrors aligned so as to produce a path of travel for said light beam that crosses over on itself at least once prior to exiting said system.

2. The system of claim 1, wherein said predetermined angle is greater than 0 degrees and less than 90 degrees.

3. The system of claim 2, wherein said predetermined angle is approximately 0.5 degrees.

4. The system of claim 1, wherein said means for driving each of said rotatable members is a motor.

5. The system of claim 1, wherein said light beam source and said plurality of members are arranged in a substantially polygonal configuration.

6. The system of claim 5, wherein said plurality of mirrors includes at least four mirrors, said four mirrors and said light beam source arranged in a pentagonal configuration and said arranged in a pentagonal configuration, each of said transverse vertical planes intersecting at substantially equivalent angles.

7. The system of claim 4, wherein said motors are variable speed motors and capable of rotating said mirror in two directions.

8. The system of claim 7, including means for controlling the speed and rotational direction of the motors.

9. An image producing system comprising:

a light beam source for producing a light beam;

a plurality of substantially planar rotatable mirrors;

means for driving each of said plurality of rotatable mirrors;

said light beam source and said plurality of rotatable mirrors arranged in a substantially pentagonal configuration, said plurality of mirrors arranged in said pentagonal configuration to reflect said light beam from said light beam source sequentially from each of said plurality of mirrors before exiting said system in a manner whereby rotation of at least one of said plurality of mirrors produces a periodic angular motion of said path of travel of said light beam;

whereby said periodic angular motion of said path of travel for said light beam produces an image in up to two dimensions when said light beam is projected on a visually detectable medium; and said plurality of rotatable mirrors arranged in said pentagonal configuration to reflect said light beam from said light beam source in a manner, whereby said light beam crosses over itself at least once prior to exiting said system.

10. The system of claim 9, wherein each of said plurality of rotatable mirrors includes, a mirror in communication with a rotating member, each of said rotating members including a longitudinal vertical plane and a transverse vertical plane extending therethrough, said longitudinal vertical plane and said transverse vertical plane oriented substantially perpendicular to each other, and each of said mirrors includes a surface defining a vertical mirror plane offset at a predetermined angle with respect to said transverse vertical plane.

11. The system of claim 10, wherein said predetermined angle is greater than 0 degrees and less than 90 degrees.

12. The system of claim 11, wherein said predetermined angle is approximately 0.5 degrees.

13. The system of claim 10, wherein said means for driving each of said plurality of rotatable mirrors is a motor.

14. The system of claim 10, wherein said plurality of said mirrors includes at least four mirrors, and each of said transverse vertical planes of said rotating members intersecting at substantially equivalent angles.

15. The system of claim 13, wherein said motors are variable speed motors and capable of rotating said mirror in two directions.

16. The system of claim 15, including means for controlling the speed and rotational direction of the motors.

17. An image producing system comprising:

a light beam source for producing a light beam;

a plurality of substantially planar mirrors;

at least one rotating member in communication with at least one mirror of said plurality of mirrors for rotating said at least one mirror of said plurality of mirrors;

means for driving each of said at least one rotating members;

said light beam source and said plurality of mirrors arranged so as to produce a path of travel for said light beam that begins at said light beam source reflects sequentially from each of said plurality of mirrors, and exits said system whereby rotation of at least one of said plurality of mirrors produces a periodic angular motion of said path of travel of said light beam;

whereby said periodic angular motion of said path of travel for said light beam produces an image in up to two dimensions when said light beam is projected on a visually detectable medium; and said light beam source and said plurality of mirrors arranged so as to produce a path of travel for said light beam that crosses over itself at least once prior to exiting said system.

18. The system of claim 17, wherein said light beam source and said plurality of mirrors are arranged in a substantially polygonal configuration.

19. The system of claim 18, wherein said plurality of rotatable mirrors includes four mirrors, and said substantially polygonal configuration is a substantially pentagonal configuration.

20. The system of claim 17, wherein said at least one rotating member includes a plurality of rotating members, said plurality of rotating members corresponding in number to said plurality of mirrors, each of said rotating members including a longitudinal vertical plane and a transverse vertical plane extending therethrough, said longitudinal vertical plane and said transverse vertical plane oriented substantially perpendicular to each other, and each of said mirrors includes a surface defining a vertical mirror plane offset at a predetermined angle with respect to said transverse vertical plane.

21. The system of claim 20, wherein said predetermined angle is greater than 0 degrees and less than 90 degrees.

22. The system of claim 21, wherein said predetermined angle is approximately 0.5 degrees.

23. The system of claim 20, wherein said means for driving each of said rotating members is a motor.

24. The system of claim 20, wherein each of said transverse vertical planes of said rotatable members intersect at substantially equivalent angles.

25. The system of claim 23, wherein said motors are variable speed motors and capable of rotating said mirror in two directions.

26. The system of claim 25, including means for controlling the speed and rotational direction of the motors.

27. The system of claim 1, wherein each of said plurality of rotatable mirrors rotates at a rotational speed, and wherein said image has a structure dependent on a ratio of the rotational speeds of each of said plurality of rotatable mirrors.

28. The system of claim 9, wherein each of said plurality of rotatable mirrors rotates at a rotational speed, and wherein said image has a structure dependent on a ratio of the rotational speeds of each of said plurality of rotatable mirrors.

29. The system of claim 17, wherein each of said plurality of mirrors rotates at a rotational speed, and wherein said image has a structure dependent on a ratio of the rotational speeds of each of said plurality of rotatable mirrors.

* * * * *